US006836083B2

(12) United States Patent
Mukai

(10) Patent No.: US 6,836,083 B2
(45) Date of Patent: Dec. 28, 2004

(54) ILLUMINATION LIGHT SUPPLY SYSTEM

(75) Inventor: Kenji Mukai, Ijonawate (JP)

(73) Assignee: Matsushita Electric Industrial Co., Ltd., Osaka-Fu (JP)

( * ) Notice: Subject to any disclaimer, the term of this patent is extended or adjusted under 35 U.S.C. 154(b) by 288 days.

(21) Appl. No.: 10/103,244

(22) Filed: Mar. 21, 2002

(65) Prior Publication Data

US 2002/0176073 A1 Nov. 28, 2002

(30) Foreign Application Priority Data

Mar. 23, 2001 (JP) ..... 2001-084809

(51) Int. Cl.[7] ..... H05B 37/00

(52) U.S. Cl. ..... 315/317; 315/312; 315/224; 362/27; 362/555; 705/412

(58) Field of Search ..... 315/312, 317, 315/325, 224; 362/27, 29, 552, 555; 705/412

(56) References Cited

U.S. PATENT DOCUMENTS 5,677,603 A * 10/1997 Speirs et al. ..... 315/324
5,836,669 A * 11/1998 Hed ..... 362/92
6,535,859 B1 * 3/2003 Yablonowski et al. ..... 705/412
6,592,245 B1 * 7/2003 Tribelsky et al. ..... 362/551

FOREIGN PATENT DOCUMENTS

JP 2000331510 11/2000

* cited by examiner

*Primary Examiner*—Haissa Philogene

(57) ABSTRACT

An illumination light supply system that can save users from the task of replacing defective light source lamps with proper ones, enabling the users to use illumination light over an extended time period, and can easily change the lighting atmosphere as requested by the user. The illumination light supply system comprises: two or more light source units that generate and output lights of different colors; mixing means for mixing the lights output from the two or more light source units; adjustment means for adjusting an amount of light supplied from each light source unit to the mixing means; light transfer means for transferring the mixed light output from the mixing means to a user; and an illumination unit that radiates the transferred light into a space for the user.

22 Claims, 10 Drawing Sheets

ILLUMINATION LIGHT SUPPLY SYSTEM

BACKGROUND OF THE INVENTION

1. Field of the Invention

The present invention relates to an illumination light supply system for supplying users with illumination light.

2. Description of the Related Art

There are variety of types of illumination equipment that are made for various environments or purposes. There are lamps specifically made for illuminating room spaces in houses, offices or the like. There are also lamps specifically made for illuminating outdoor spaces such as roads, parks, sports facilities or the like.

Such illumination equipment are achieved by high-discharge lamps such as metal halide lamps or high pressure mercury lamps, electrodeless discharge lamps, fluorescent lamps, incandescent lamps, or light source lamps that emit light using electric energy. However, all these lamps have a limited lifetime. As a result, every time a lamp fails due to the limited lifetime, the user needs to replace it with a new one.

This task can be burdensome to many users. Especially, replacing lamps attached to high ceilings or street lamps, which can be a difficult task.

Also, users sometimes feel like changing the particular lighting atmosphere. Such a demand is especially strong among users of interior rooms.

However, it is difficult for users of ordinary illumination equipment to change the lighting atmosphere without replacing the lamps. As a result, changing the lighting atmosphere variously in accordance with users' requests is difficult in reality.

SUMMARY OF THE INVENTION

The first object of the present invention is therefore to provide an illumination light supply system that can save users from the task of replacing defective light source lamps with proper ones, enabling the users to use illumination light over an extended time period.

The second object of the present invention is to provide an illumination light supply system that can easily change the lighting atmosphere as requested by the user.

The first object is fulfilled by an illumination light supply system, comprising: a light source unit that generates and outputs light; light transfer means that transfers the light output from the light source unit to a user; and an illumination unit that radiates the transferred light into a space for the user.

Note that in the above description, the "user" refers to (a) a person (household) who directly uses the illumination light or (b) a manager of a facility where the illumination light is used.

The illumination light supply system is managed by a "supplier" who supplies users with the illumination light. If, for example, a lamp used in the light source unit goes out, the supplier must replace the defective lamp with an appropriate one. Here, the "supplier" refers to a person, a municipality, or a company that supplies users with the illumination light.

With the above-described construction, the light source unit outputs light over an extended time period, and the light is transferred to the user by the light transfer means and emitted into a space by the illumination unit. As a result, the illumination light supply system saves users from the task of replacing defective light source lamps with proper ones, enabling the users to use illumination light over an extended time period.

The above illumination light supply system may further comprise charging means for charging the user for illumination light the user has used, and the charging means may include: a light amount measuring unit that measures an amount of light transferred by the light transfer means to the user; and a storage unit that stores and accumulates the measured amount of light to have information of an accumulated amount of light, wherein the charging means charges the user an illumination light usage charge in accordance with the accumulated amount of light stored in the storage unit.

With the above-described construction, the user is supposed to pay a usage fee to the supplier, where the usage fee is determined in accordance with the accumulated amount of light for the user.

The above objects are fulfilled by an illumination light supply system, comprising: two or more light source units that generate and output lights of different colors; mixing means for mixing the lights output from the two or more light source units; adjustment means for adjusting an amount of light supplied from each light source unit to the mixing means; light transfer means for transferring the mixed light output from the mixing means to a user; and an illumination unit that radiates the transferred light into a space for the user.

The above objects are also fulfilled by an illumination light supply system, comprising: two or more light source units that generate and output lights of different colors; light transfer means for transferring the lights of different colors output from the two or more light source units to a user; a mixing means for mixing the lights transferred by the light transfer means; adjustment means for adjusting an amount of each of the lights transferred by the light transfer means; and an illumination unit that radiates the mixed light into a space for the user.

With either of the above-described constructions, both the first and second objects of the present invention are fulfilled. That is to say, the illumination light supply system can easily change the lighting atmosphere as requested by the user.

BRIEF DESCRIPTION OF THE DRAWINGS

These and the other objects, advantages and features of the invention will become apparent from the following description thereof taken in conjunction with the accompanying drawings which illustrate a specific embodiment of the invention.

In the drawings.

DESCRIPTION OF THE PREFERRED EMBODIMENT

The following description is provided to enable any person skilled in the art to make and use the invention and sets forth the best modes contemplated by the inventors of carrying out their invention. Various modifications, however, will remain readily apparent to those skilled in the art of providing a distribution of light to consumers.

Embodiment 1

Figure 1:
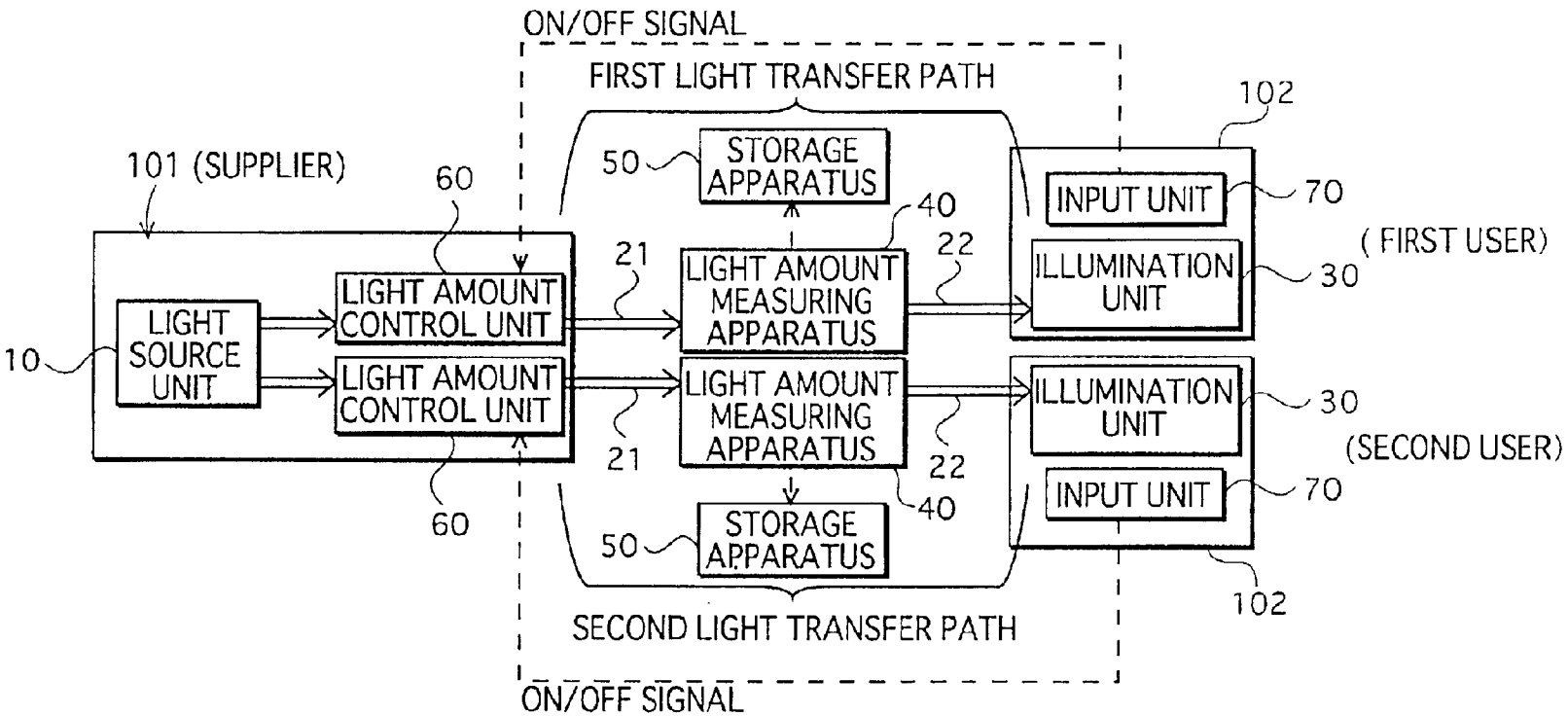
FIG. 1 is a block diagram of an illumination light supply system in Embodiment 1.
Figure 2:
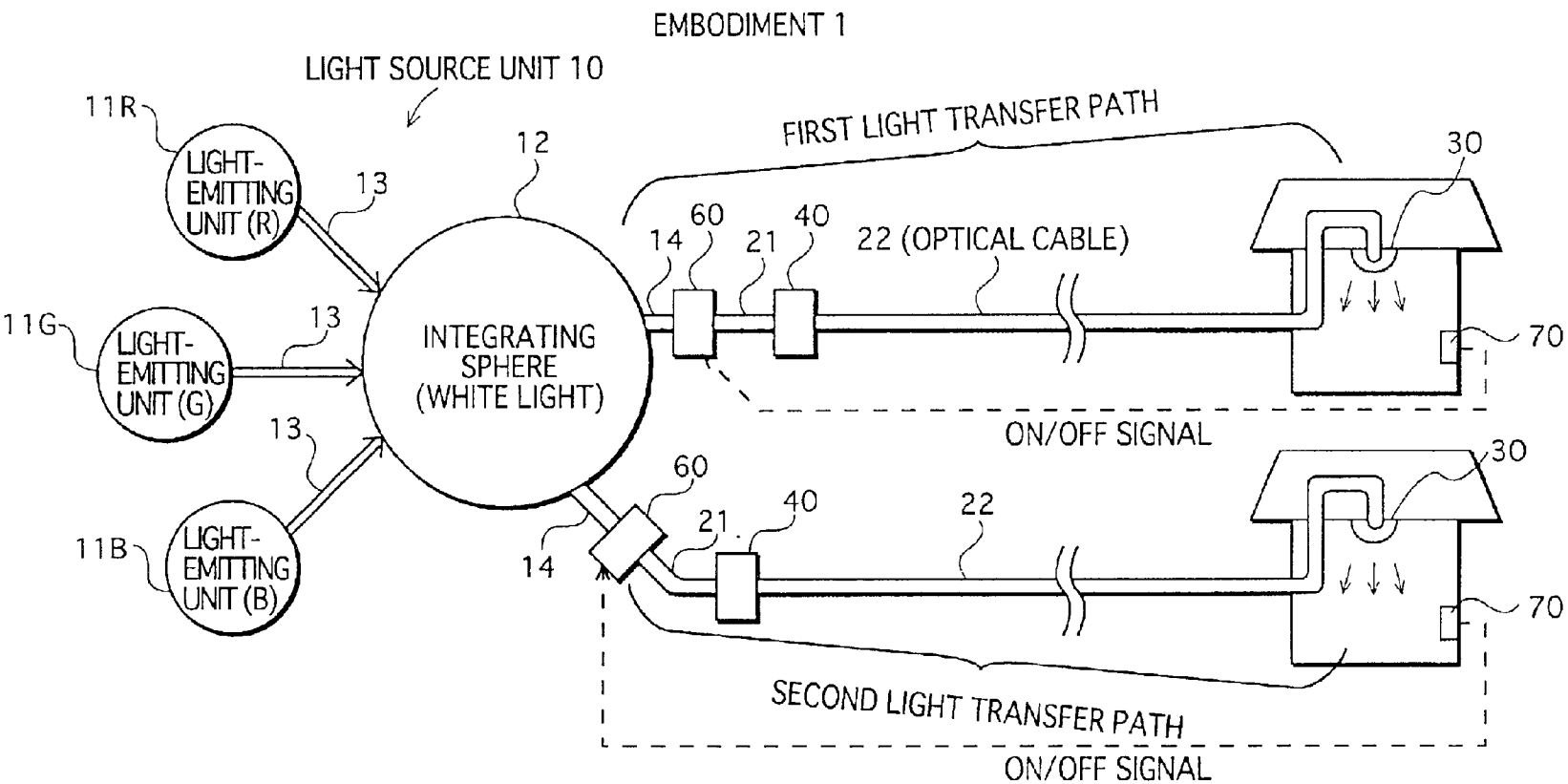
FIG. 2 shows the construction of the illumination light supply system.

FIG. 1 is a block diagram of an illumination light supply system in Embodiment 1. In FIG. 1, hollow arrows indicate light transfer paths. FIG. 2 shows the construction of the illumination light supply system.

In this illumination light supply system shown in FIGS. 1 and 2, a light supply apparatus 101 managed by a supplier (for example, an illumination light supply company) supplies the lighting apparatuses 102 (houses of users) possessed respectively by the two users with illumination light. That is to say, a light source unit 10 provided in the light supply apparatus 101 supplies a first user with illumination light via a first light transfer path, and supplies a second user with illumination light via a second light transfer path.

The first and second light transfer paths respectively include optical cables 21 and 22 as light transfer means for transferring light from the light source unit 10 to the users. The optical cables 21 and 22 respectively extend to illumination units 30 that radiate light into room spaces of the users. The illumination light supply system further includes: light amount measuring apparatuses 40 for measuring the amounts of light transferred to respective users: storage apparatuses 50 for storing accumulated amounts of light measured respectively by the light amount measuring apparatuses 40; light amount control units 60 for controlling the amount of light transferred to the users; and input units 70 for transmitting ON/OFF signals to the light amount control units 60 in accordance with ON/OFF instructions from the users.

In the present illumination light supply system, the light amount control units 60 are provided in the light supply apparatus 101, and illumination units 30 and input units 70 are provided in the lighting apparatuses 102.

The information transfer means used to transfer the ON/OFF signals from the input units 70 to the light amount control units 60 may be public lines such as telephone lines or the Internet, as well as dedicated lines and radio communications.

Construction of Light Source Unit

The light source unit 10 shown in FIG. 2 is composed of an integrating sphere 12, a light-emitting unit 11R for emitting red light, a light-emitting unit 11G for emitting green light, and a light-emitting unit 11B for emitting blue light, where these light-emitting units are attached to the integrating sphere 12.

Generally, an integrating sphere is used to measure the diffuse reflectance or permeability of objects. In the present embodiment, the integrating sphere is used to mix and branch light, as will be described now.

Figure 3:
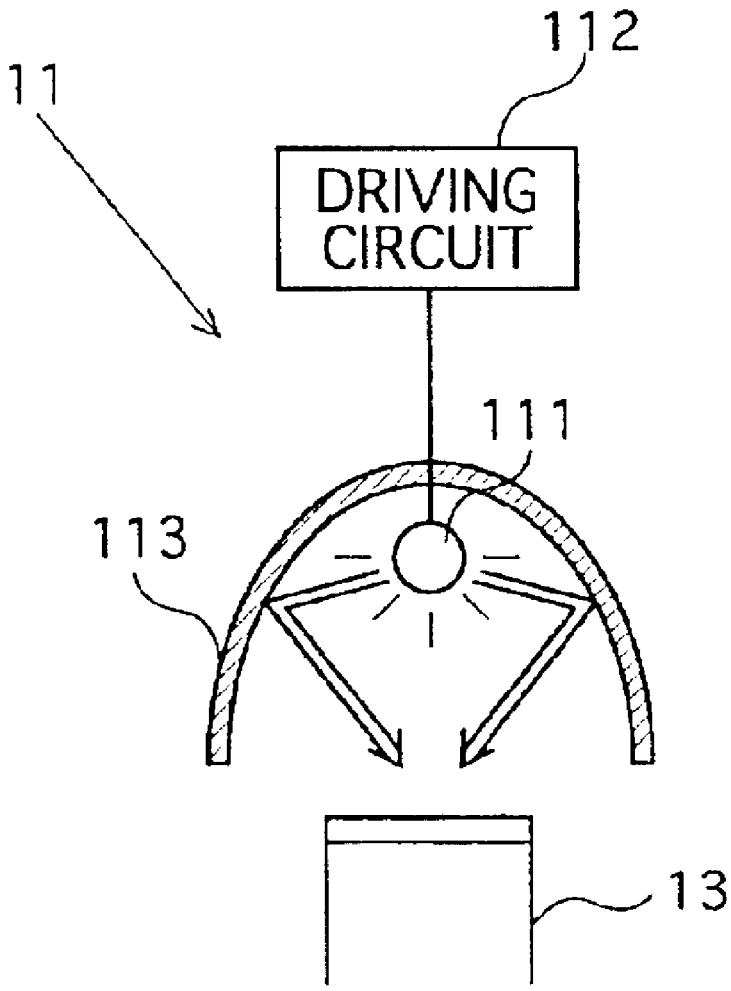
FIG. 3 shows an example of the light-emitting unit.

Each of the light-emitting units (11R, 11G, and 11B) has the construction shown in FIG. 3, for example. According to the construction shown in FIG. 3, each light-emitting unit has a light-emitting lamp 111 that emits light, a driving circuit 112 that drives the light-emitting lamp 111, a condenser 113 that condenses the light emitted by the light-emitting lamp and sends the condensed light into an incoming window unit 13 of the integrating sphere 12. The condenser 113 may be achieved by a reflector as shown in FIG. 3, a condenser lens, or a combination of a reflector and a condenser lens.

A fluorescent lamp of red, green, or blue may be used as the light-emitting lamp 111.

The integrating sphere 12 is a hollow ball, and the entire inner surface of the integrating sphere 12 is coated with a white dispersing agent. The integrating sphere 12 has a plurality of incoming window units 13 and a plurality of outgoing window units 14. As shown in FIG. 2, the light-emitting units 11R, 11G, and 11B are attached to the three incoming window units 13 of the integrating sphere 12, respectively.

With the above construction, the lights emitted from the light-emitting units 11R, 11G, and 11B enter the integrating sphere 12 through respective incoming window units 13, and the lights are diffused and mixed to become white light. The white light is branched and out put to the first and second light transfer paths via respective outgoing window units 14.

FIG. 2 shows that three light-emitting units provide the light source unit 10 with lights of different colors, respectively. Not limited to this, only one light-emitting unit 11 may be used to provide light of one color, or a plurality of light-emitting units 11 may be used to provide light of the same color. In these cases, the light-emitting lamp 111 used in the light-emitting unit 11 may be (i) a high-pressure discharge lamp such as a metal halide lamp or a high-pressure mercury lamp, (ii) an electrodeless discharge lamp, or (iii) an incandescent lamp.

In the case where a plurality of light-emitting units 11 are used to provide light of the same color, it is possible to change the optical-power output of the light source unit 10 by changing the number of light-emitting units emitting light.

Now, the optical cables 21 and 22, illumination units 30, and light amount measuring apparatuses 40 will be described. The description applies to both the first and second light transfer paths.

Optical Cables 21 and 22, Illumination Units 30

The optical cables 21 and 22 may be optical fiber cables which are bundles of optical fibers made of glass with high transmittance (e.g. quartz glass). Note that the optical cables may be hollow optical pipes or ducts, as well.

Figure 4:
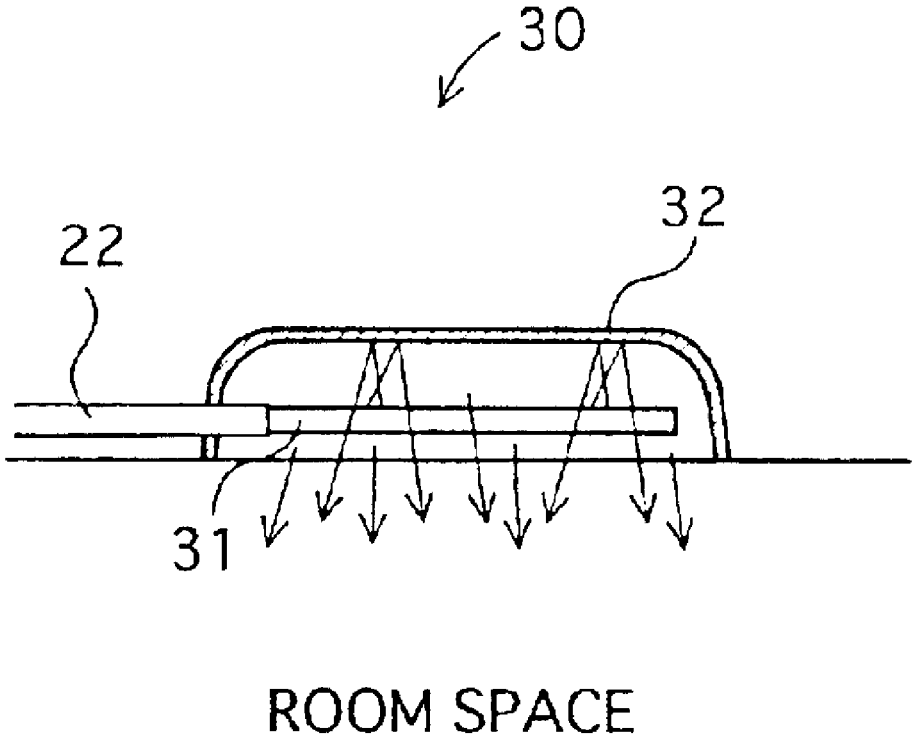
FIG. 4 shows an example of the construction of the illumination unit.

FIG. 4 shows an example of the illumination unit 30.

The illumination unit 30 includes: a light diffusion medium 31 connected to an output end of the optical cable 22; and a reflecting mirror 32.

The light diffusion medium 31 is a semitransparent resin bar that receives light from the optical cable 22 and radiates the light on all sides as illumination light. The reflecting mirror 32 reflects the illumination light radiated by the light diffusion medium 31 so that the reflected light travels toward the room space. This construction allows the light transferred via the optical cables 21 and 22 to be effectively radiated toward the room space as illumination light.

Construction of Light Amount Control Unit 60

Figure 5:
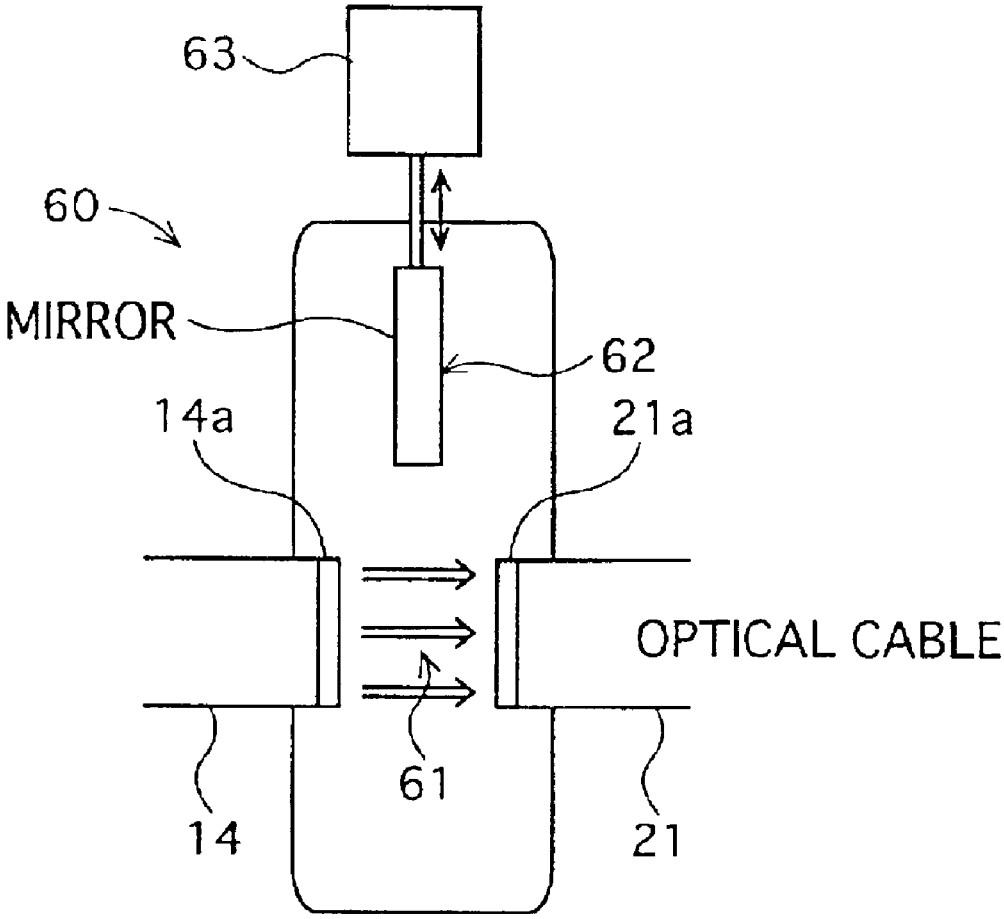
FIG. 5 shows the construction of the light amount control unit.

FIG. 5 shows the construction of the light amount control units 60.

In the present illumination light supply system, the light amount control units 60 are directly attached to the light source unit 10, as shown in FIG. 5. More particularly, the light amount control unit 60 is attached to each of the two outgoing window units 14 of the integrating sphere 12.

In the light amount control unit 60, an output end 14*a* of the outgoing window unit 14 and an input end 21*a* of the optical cable 21 face each other with a gap 61 between. The output end 14*a* has a condenser lens that condenses light output from the outgoing window unit 14 so that the condensed light travels toward the input end 21*a*. With this construction, the luminous flux output from the outgoing window unit 14 pass through the gap 61 and enter the optical cable 21.

The light amount control unit 60 has a shielding reflection plate 62 and a driving unit 63. The driving unit 63 inserts and withdraws the shielding reflection plate 62 into/from the gap 61, adjusting the extent of the insertion and withdrawal. A surface of the shielding reflection plate 62 facing the output end 14*a* has a mirror finish.

FIG. 5 shows only one shielding reflection plate 62 for the sake of convenience. It is desirable however that the light amount control unit 60 has a plurality of shielding reflection plates arranged circularly as the diaphragm in cameras.

The light amount control unit 60 can adjust a ratio of the amount of luminous flux input to the optical cable 21 to the amount of luminous flux output to the gap 61 from the outgoing window unit 14 (opening ratio) by adjusting the extent of insertion of the shielding reflection plate 62 into the gap 61 as follows.

When the shielding reflection plate 62 is not inserted into the gap 61 at all (opening ratio at 100%), all luminous flux output to the gap 61 from the outgoing window unit 14 is input to the optical cable 21. When the shielding reflection plate 62 is inserted to the fullest extent (opening ratio at 0%), all luminous flux output to the gap 61 is reflected by the shielding reflection plate 62 back into the integrating sphere 12 to be reclaimed as an output from the light source unit 10. When the shielding reflection plate 62 is partially inserted into the gap 61, part of the luminous flux output to the gap 61 is reflected by the shielding reflection plate 62 and returns to the integrating sphere 12, and the rest of the luminous flux enters the optical cable 21.

It should be noted here that the light amount control units 60 may be attached to the outgoing window units 14 of the integrating sphere 12 via optical cables. However, it is desirable that they are attached directly as described in the present embodiment since in this case, less amount of optical energy is lost during a time period in which the light reflected by the shielding reflection plate 62 returns to the integrating sphere 12.

The driving unit 63 is activated by an ON/OFF signal sent from the input unit 70. Upon receiving an ON signal, the driving unit 63 inserts the shielding reflection plate 62 into the gap 61; and upon receiving an OFF signal, the driving unit 63 withdraws the shielding reflection plate 62 from the gap 61. This enables the illumination light emitted from the illumination units 30 to be turned ON or OFF according to ON/OFF instructions issued by the users via the input units 70.

The adjustment of the light emitted from the illumination units 30 (lighting control) can also be made as follows.

Users can specify a amount of light to be emitted from the illumination unit 30, as well as issuing an ON/OFF instruction, using the input units 70 of the lighting apparatuses 102. The input units 70 send values of the specified light amounts to the light amount control units 60. The light amount measuring apparatuses 40 continuously transmit values of light amounts they measure to the light amount control units 60. The light amount control units 60 control the opening ratio so that the measured light amounts match the specified light amounts sent from the input units 70.

The light amount control units 60 can also control the amount of light by inserting an ND (Neutral Density) filter into the gap 61. In this case, however, the light cannot be reused since the ND filter absorbs the light and does not reflect the light back into the integrating sphere 12. In contrast, use of the shielding reflection plate 62 enables the light to be reused, as described above.

Construction of Light Amount Measuring Apparatus 40

The light amount measuring apparatuses 40 measures in real time the amount of light (amount of luminous flux) supplied to the illumination units 30 and stores the measured amount of light in the storage apparatuses 50. The storage apparatuses 50 store accumulated amounts of light.

Figure 6:
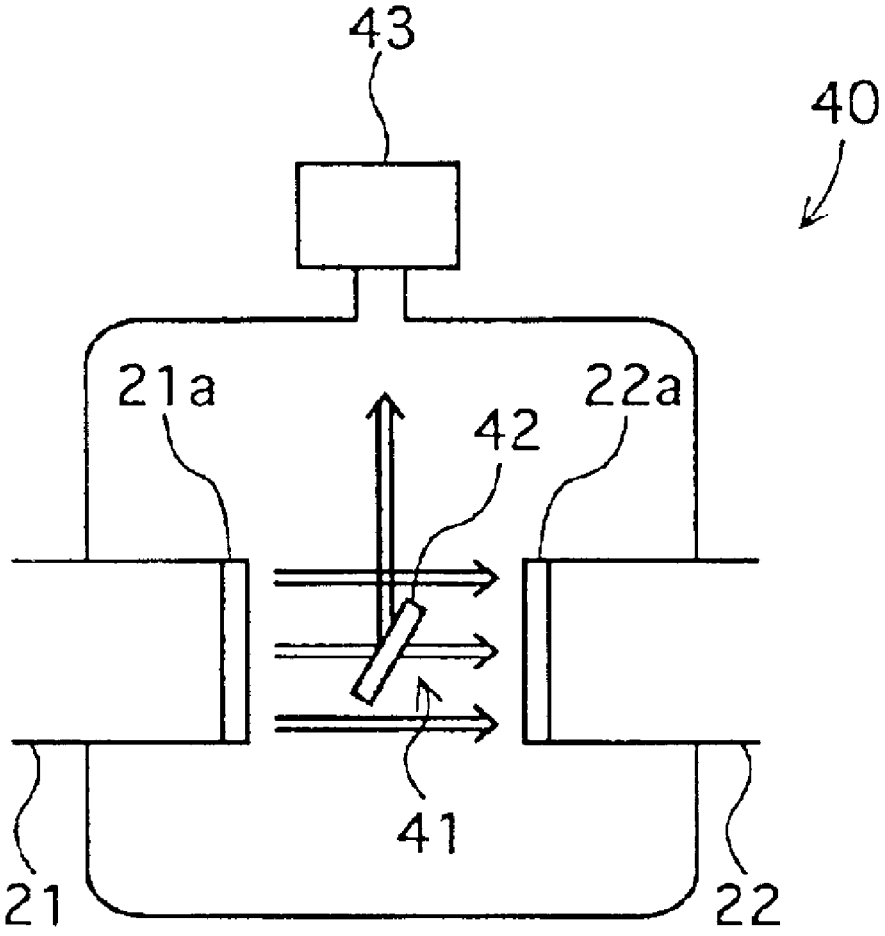
FIG. 6 shows the construction of the light amount measuring apparatus.

As shown in FIG. 6, in the light amount measuring apparatuses 40, an output end 21*a* of the optical cable 21 and an input end 22*a* of the optical cable 22 face each other with a gap 41 between. The output end 21*a* has a condenser lens that condenses light output from the optical cable 21 so that the condensed light travels toward the input end 22*a*. With this construction, the luminous flux output from the optical cable 21 passes through the gap 41 and enter the optical cable 22.

A half mirror 42 is provided in the gap 41. The half mirror 42 reflects part of the light passing through the gap 41 so that the reflected light is input into an illuminance meter 43. Generally, a half mirror often refers to a mirror that branches light equally into transferred light and reflected light. However, it is desirable from the viewpoint of reducing the loss that the half mirror 42 branches light into more of an amount of transferred light than reflected light.

The illuminance (lx) measured by the illuminance meter 43 is proportionate to the amount of luminous flux (lm) transferred from the optical cable 21 to the optical cable 22. As a result, the amount of luminous flux can be obtained from a value of the illuminance measured by the illuminance meter 43.

The light amount measuring apparatuses 40 have a timer circuit (not illustrated) for measuring time, evaluate the integral of (i) the illuminance measured in real time by the illuminance meter 43 and (ii) the illumination light usage time (seconds) measured by the timer circuit, and store the obtained integral values into the storage apparatuses 50. The integral values correspond to the accumulated amounts of light supplied from the light supply apparatus 101 to the lighting apparatuses 102.

It should be noted here that the light amount measuring apparatuses 40 may use a luminance meter instead of an illuminance meter, and measure the luminance in real time so that the amount of luminous flux (lm) is obtained from the measured luminance (cd/m$^2$).

Operation of Illumination Light Supply System

In the illumination light supply system, the light source unit 10 of the light supply apparatus 101 continuously generates light. The generated light can always be supplied to each illumination unit 30 via the first or second light transfer path.

Users input an ON instruction into the input units 70 of the lighting apparatuses 102 when requiring illumination, and input an OFF instruction when not requiring illumination any more. The light amount control unit 60 is opened for a time period specified by the user (after an ON instruction is input until an OFF instruction is input), and the illumination unit 30 continues to emit illumination light for the specified time period.

The amount of illumination light used by a user is measured by a light amount measuring apparatus 40 corresponding to the user, and the accumulated amount is stored in the corresponding storage apparatus 50.

Up to now, a case where one supplier supplies illumination light to two users has been explained with reference to FIGS. 1 and 2. However, it is also possible that one supplier supplies illumination light to one user, or that one supplier supplies illumination light to three or more users.

Output Control by Light Source Unit 10

The light source unit 10 may output constant amount of light regardless of the number of lighting requests (the number of input units 70 instructed to be ON in the whole system). This method, however, produces a loss. An alternative method is as follows. The light source unit 10 outputs variable amount of light so that as the number of lighting requests increases, the output of the light source unit 10 increases.

Figure 7:
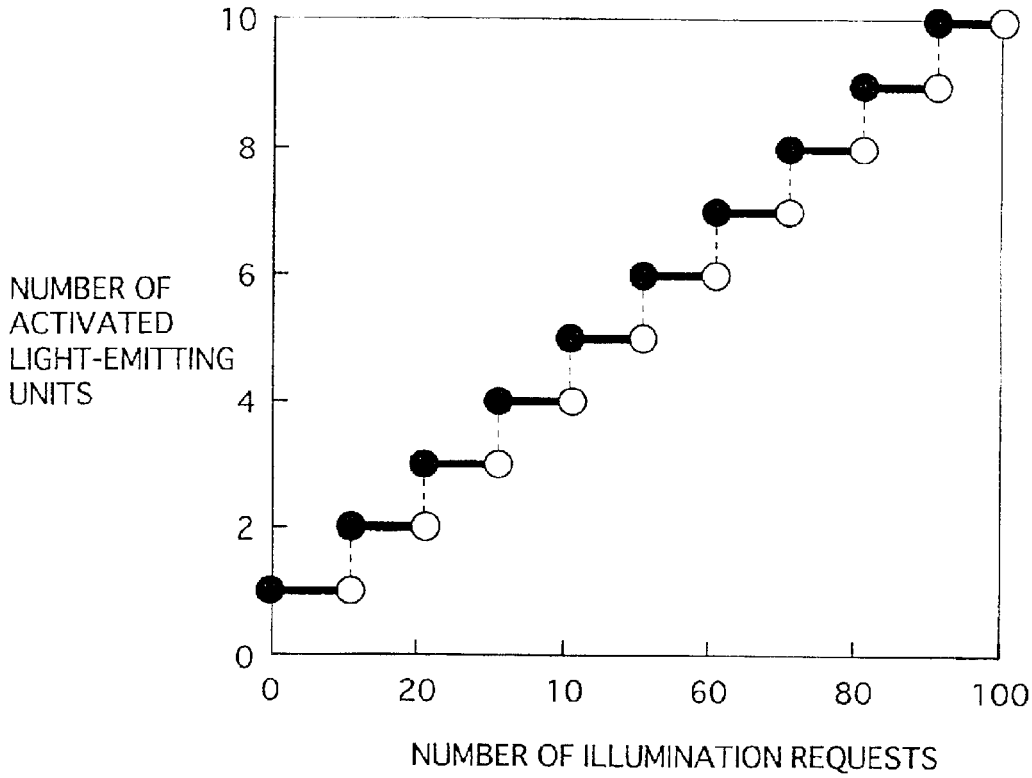
FIG. 7 shows an example of the output control method for the light source unit.
Figure 8A:
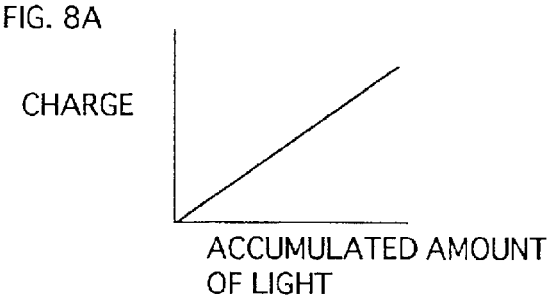
FIG. 8 shows several methods of determining charges for users.
Figure 8B:
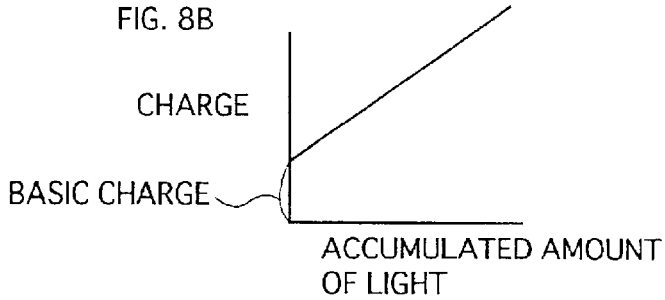
Figure 8C:
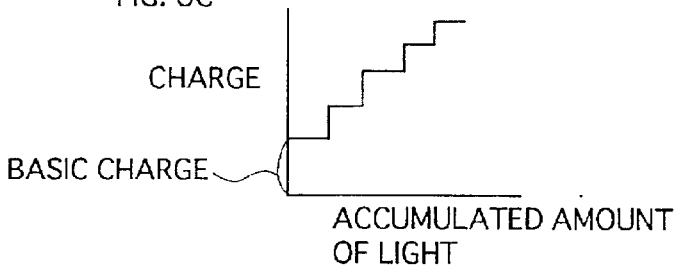
Figure 8D:
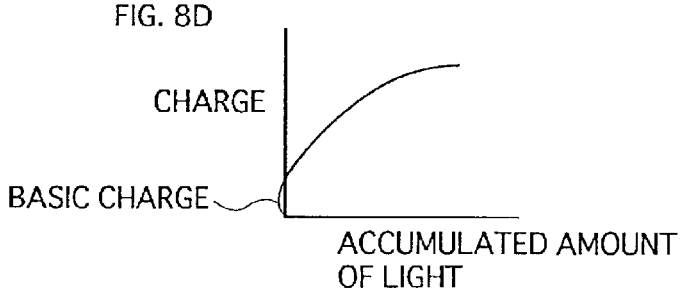
Figure 8E:
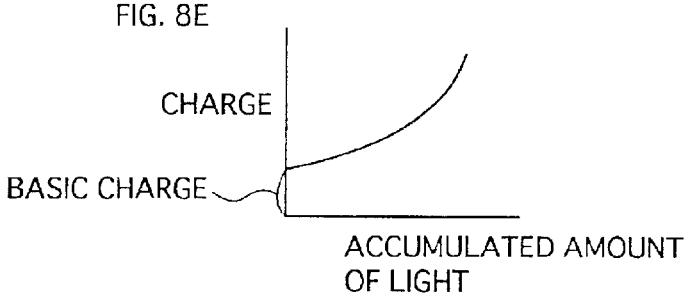

FIG. 7 shows an example of the output control method for the light source unit 10.

It is presumed in this example that the light source unit 10 has 10 light-emitting units 11, that the whole illumination light supply system has 100 illumination units 30, and that to make all the 100 illumination units 30 emit light, all the 10 light-emitting units 11 need to emit light. In this case, the number of lighting requests varies from 0 to 100.

In the above conditions, if the amount of light output from the light source unit 10 is fixed to a constant value, all the 10 light-emitting units need to emit light continuously in preparation for the case where 100 lighting requests are issued at the same time. With this arrangement, a loss is produced when a small number of lighting requests are issued.

On the other hand, the number of the light-emitting units that are emitting light in the light source unit 10 may be varied from 1 to 10, for example. In this case, 1 light-emitting unit emits light when 0 to 9 lighting requests are issued, 2 light-emitting units emit light when 10 to 19 lighting requests are issued, . . . 10 light-emitting units emit light when 90 to 100 lighting requests are issued, as shown in FIG. 7. With this arrangement, as much of an amount of light as required is supplied. This arrangement also reduces the amount of loss compared with the above-described arrangement where the output of the light source unit 10 is constant.

Maintenance of Light Source Unit

The maintenance of the light supply apparatus 101 including the light source unit 10 is performed by the supplier who manages the apparatus. For example, when the light of a light-emitting lamp goes out, the supplier repairs or replaces it with another one. This saves users from the burdensome task of replacing defective lamps with unused ones, thus enabling the users to use illumination light over an extended time period (semipermanently) on an as-needed and as-much-as-required basis.

Charging

The present illumination light supply system has a charging means (not illustrated) that charges each user for the use of illumination light on a regular basis.

The charge for each user is determined in accordance with the accumulated amount of illumination light stored in the storage apparatus 50.

More specifically, the charge for each user is determined by dividing the total amount of costs for system facilities amortization, operating, maintenance or the like into the users, based on the ratio of the accumulated amount of light of each user. That is to say, as the accumulated amount of illumination light of a user increases, the charge for the user increases.

FIG. 8 shows several methods of determining the charges.

In the method (a), the charges increase in proportionate to the accumulated amounts of illumination light.

Each of the methods (b) to (e) adopts a combination of a basic charge and a usage-based charge. However, these methods differently calculate the usage-based charges.

In the method (b), the charges increase in proportionate to the accumulated amounts of illumination light.

In the method (c), the charges increase step-by-step approximately in proportionate to the accumulated amounts of illumination light.

In the method (d), as the accumulated amounts of illumination light increase, the charges increase, with the charge increase rate diminishing.

In the method (e), as the accumulated amounts of illumination light increase, the charges increase, with the charge increase rate growing.

The users are expected to pay the charges to the supplier.

It should be noted here that although the above charging methods are generally preferable, a constant amount different for each user may be charged for each user.

Embodiment 2

Figure 9:
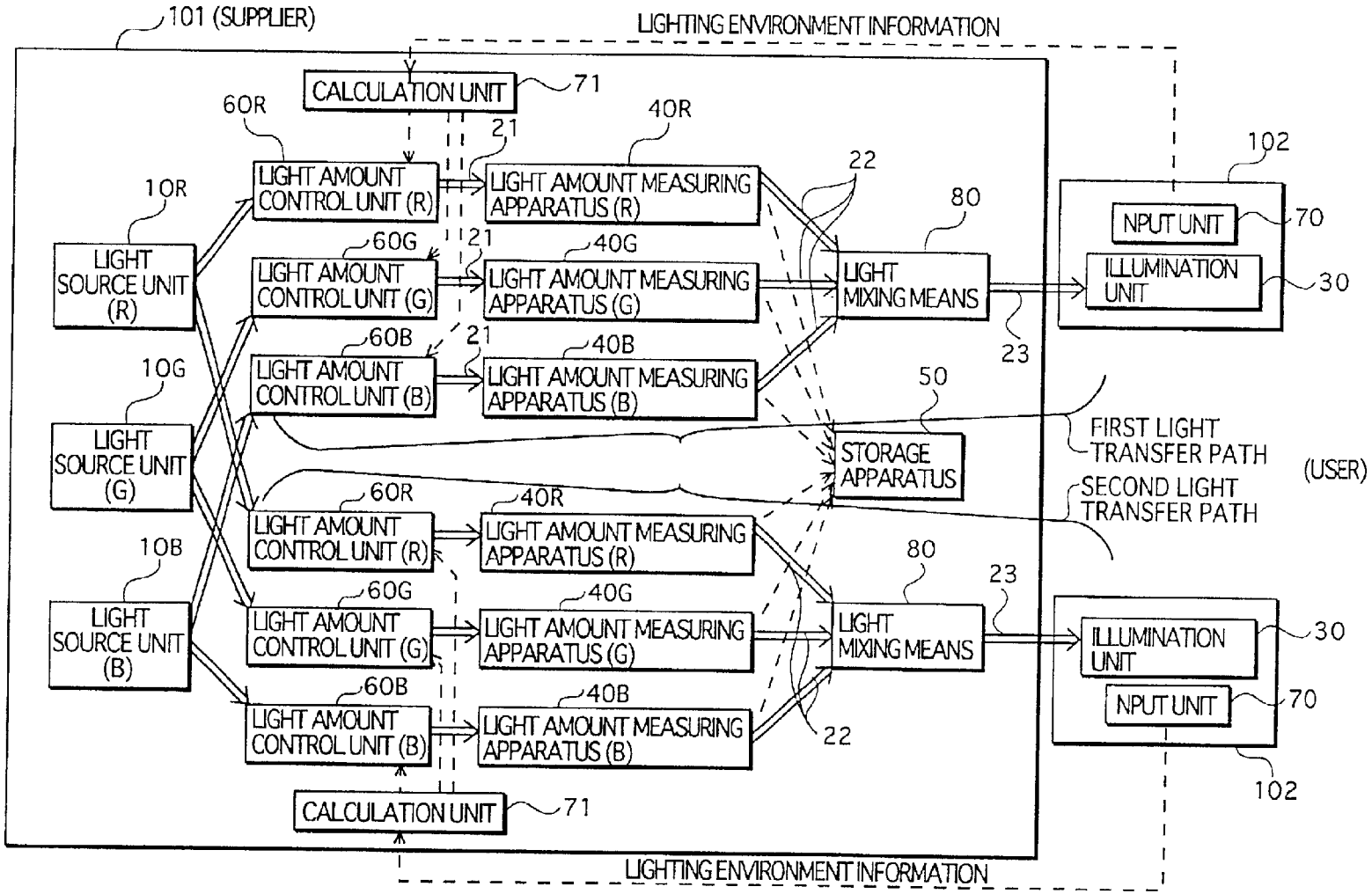
FIG. 9 is a block diagram of an illumination light supply system in Embodiment 2.
Figure 10:
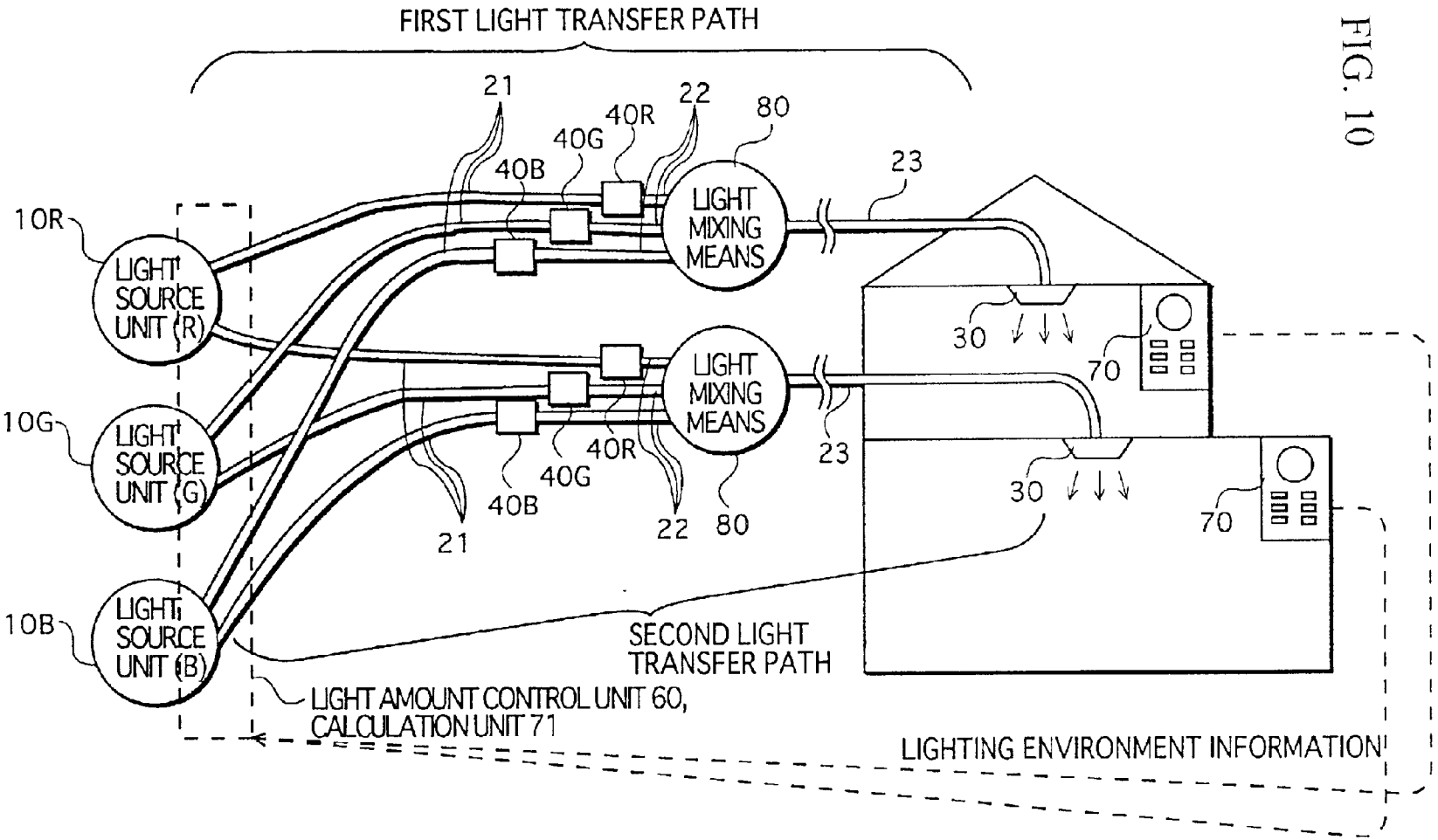
FIG. 10 shows the construction of the illumination light supply system.

FIG. 9 is a block diagram of an illumination light supply system in Embodiment 2. FIG. 10 shows the construction of the illumination light supply system.

Note that the same components in Embodiments 1 and 2 have the same reference numbers. Also note that FIGS. 9 and 10 are based on an example in which light is supplied to a house (containing the lighting apparatuses 102) managed by one user, for the sake of convenience.

As shown in FIG. 9, the present illumination light supply system has three light source units 10R, 10G, and 10B that generate and output different colors red (R), green (G), and blue (B), respectively. The light from each light source unit is branched and output to the first and second light transfer paths, then to corresponding rooms as the illumination light.

It should be noted here that the first and second light transfer paths extend to two rooms in a house owned by a user, respectively. That is to say, the two lighting apparatuses 102 shown in FIG. 9 are provided in a house managed by one user.

Each light transfer path has: light amount control units 60R, 60G, and 60B for controlling the amount of light of corresponding colors respectively output from the light source units 10R, 10G, and 10B; light amount measuring apparatuses 40R, 40G, and 40B for measuring the amounts of light respectively output from the light amount control units 60R, 60G, and 60B; optical cables 21 and 22 as light transfer means for transferring light of each color; a light mixing means 80 for mixing lights of different colors output from the light amount control units 60R, 60G, and 60B; and an optical cable 23 that is used to transfer the mixed light. The optical cable 23 extends to the illumination units 30 that illuminate the rooms managed by the user.

In the present embodiment, the light transferred via the first and second light transfer paths is used by one user. As a result, amounts of illumination light measured by the light amount measuring apparatuses 40R, 40G, and 40B are stored and accumulated in one storage apparatus 50.

In the present embodiment, as shown in FIG. 9, the light amount control units 60R, 60G, and 60B, the light amount measuring apparatuses 40R, 40G, and 40B, and the light mixing means 80 are provided in the light supply apparatus 101, as well as the light source units 10R, 10G, and 10B.

Each light source unit of the present embodiment also has a light-emitting unit attached to an incoming window unit of an integrating sphere, but in a different way from the light source unit 10 in Embodiment 1. That is to say, only a red light-emitting unit is attached to the red light source unit 10R, only a green light-emitting unit is attached to the green light source unit 10G, and only a blue light-emitting unit is attached to the blue light source unit 10B.

The light mixing means 80 may be realized by the same integrating sphere as the integrating sphere 12 in Embodiment 1.

In the above case, three incoming windows of the integrating sphere are connected with the light amount measuring apparatuses 40R, 40G, and 40B via optical cables 22, respectively. The outgoing window units of the integrating sphere are connected with the illumination units 30 via the optical cables 23.

With the above construction, the lights of different colors output from the light source units 10R, 10G, and 10B are mixed by the light mixing means 80, and the mixed light reaches the illumination units 30 via the optical units 23 and is emitted into the room spaces.

The light amount control units 60 can adjust the color tone of the illumination light to be emitted from the illumination units 30 by adjusting the amounts of respective colored lights output from the light source units 10R, 10G, and 10B and sending the adjusted amounts of colored lights to the light mixing means 80. The following is a detailed description of the process.

Color Tone Adjustment of Illumination Light

The amount of light for each color is adjusted by the light amount control units 60 in accordance with the "lighting environment" requested by users.

A typical "lighting environment" includes a color temperature, light intensity, average color rendering index (Ra). In this example, the light amount control units 60 adjusts the amount of light for each color to achieve the color temperature requested by a user.

The input unit 70 can receive designation of "color temperature" as one element in the lighting environment, as well as ON/OFF instruction, from the user.

The input unit 70 sends "lighting environment information" for the lighting environment designated by the user, to the light supply apparatus 101 via information transfer means (such as dedicated lines, radio communications, telephone lines or the Internet as described in Embodiment 1).

The light supply apparatus 101 has calculation units 71. Each calculation unit 71 receives the lighting environment information from the input unit 70, and calculates, based on the received information, the amount of light to be transferred from each of the light source units 10R, 10G, and 10B to the light mixing means 80. The light amount control units 60R, 60G, and 60B adjust the amount of light based on the light amount specification values calculated by the calculation units 71. For this light amount calculation, a table may be stored in each calculation unit 71, where the table shows correspondence between (a) the ratio of lights transferred from the light source units 10R, 10G, and 10B to the light mixing means 80 and (b) values of the lighting environment. Then the calculation units 71 can perform the calculation by referring to the correspondence tables.

The light amounts calculated by the calculation units 71 are sent as the light amount specification values to the light amount control units 60R, 60G, and 60B.

The light amount control units 60R, 60G, and 60B open or close in accordance with the ON/OFF signal sent from the input unit 70, and also adjust the opening ratio so that the amount of light transferred from each of the light amount control units 60R, 60G, and 60B to the light mixing means 80 matches the light amount specification value sent from the calculation unit 71.

Now, the operation of adjusting the color tone performed by the calculation unit 71 and light amount control units 60R, 60G, and 60B will be described with specific examples.

It is presumed here that the input unit 70 can receive user designation of one of 3000K, 5000K, and 6700K for the color temperature as "lighting environment".

The following Table 1 shows relationships between (a) the ratio of lights of red, green, and blue and (b) color temperatures.

TABLE 1

| | R | G | B |
|---|---|---|---|
| 3000K | 40% | 58% | 2% |
| 5000K | 27% | 61% | 12% |
| 6700K | 23% | 58% | 18% |

This table shows that the specified color temperature (3000K, 5000K, or 6700K) is achieved by setting the amounts of light transferred from the light amount control units 60R, 60G, and 60B to the light mixing means 80 to the values indicated in the table. Table 1 is stored in each calculation unit 71.

After receiving the lighting environment information (one of 3000K, 5000K, and 6700K) from the input units 70, the calculation units 71 obtain the ratio of the amounts of light to be transferred from the light source units 10R, 10G, and 10B to the light mixing means 80 by referring to the correspondence table.

For example, after receiving lighting environment information "5000K" from the input unit 70, the calculation unit 71 refers to Table 1 and sends "light amount specification value=0.27", "light amount specification value=0.61", and "light amount specification value=0.12" to the light amount control units 60R, 60G, and 60B, respectively.

The light amount control units 60R, 60G, and 60B adjust the amounts of light to be transferred from the light source units 10R, 10G, and 10B to the light mixing means 80 to be the ratio of the light amount specification values (0.27, 0.61, and 0.12).

As a result of this, the light mixing means 80 generates light having color temperature of 5000K. The light is sent to the lighting apparatuses 102 via the optical cable 23, and emitted from the illumination unit 30.

In the above example, the total amount of light transferred from the light source units 10R, 10G, and 10B to the light mixing means 80 is set to be always "1". However, not only the color temperature but also the illumination light amount of the light emitted from the illumination unit 30 can be adjusted by the following method.

The input unit 70 can specify a requested "illumination light amount X", as well as "color temperature", both as the "lighting environment information".

The input unit 70 sends "illumination light amount X" together with "color temperature" to the calculation unit 71. On receiving these values, the calculation unit 71 obtains light amount specification values by multiplying the values obtained from Table 1 with the illumination light amount X, and sends the obtained light amount specification values to the light amount control units 60R, 60G, and 60B, respectively.

As a result of the above operation, the light emitted from the illumination units 30 has color temperature of 5000K, and at the same time, the light amount is X times the total light amount "1" of the former example.

Operation and Charging of Illumination Light Supply System

Users input an ON instruction together with a color temperature into the input units 70 when requiring illumination, and input an OFF instruction when not requiring illumination any more.

With this arrangement, the light amount control units 60R, 60G, and 60B are opened for a time period specified by the user, and the illumination unit 30 continues to emit illumination light for the specified time period. At the same time, the opening ratio of the light amount control units 60R, 60G, and 60B is adjusted in accordance with the color temperature specified by the user. With this construction, the illumination unit 30 emits illumination light having the specified color temperature.

As is the case with Embodiment 1, the used amounts of color lights are respectively measured by the light amount measuring apparatuses 40R, 40G, and 40B, and the measured amounts are stored and accumulated in the storage apparatus 50.

As for the charging, as is the case with Embodiment 1, the supplier determines a charge for illumination light for each user in accordance with the accumulated amount of illumination light stored in the storage apparatus 50, and charges each user on a regular basis. Users pay the charges to the supplier.

Advantageous Effects of Present Illumination Light Supply System

As is the case with Embodiment 1, users are saved from the burdensome task of replacing defective lamps with unused ones, and users can use illumination light over an extended time period on an as-needed and as-much-as-required basis. In addition to this, users of the illumination light supply system in the present embodiment can easily change the lighting atmosphere by inputting the lighting environment information into the input units 70.

Variations and Others

In the above embodiments, three light source units 10R, 10G, and 10B output different colors for color tone adjustment. However, two light source units or four or more light source units respectively outputting different colors may be used instead.

FIGS. 9 and 10 in Embodiment 2 show a most simple example where only one house managed by one user is supplied with light. However, it is possible for the illumination light supply system of the present invention to supply illumination light to two or more houses (light supply apparatuses) managed by different users by further connecting the third light transfer path, the fourth light transfer path, . . . with the light source units 10G, 10G, and 10B.

In Embodiment 2, lights of different colors are mixed in the light supply apparatus 101 containing the light amount control units 60R, 60G, and 60B, the light amount measuring apparatuses 40R, 40G, and 40B, and the light mixing means 80, and the mixed light is transferred to the lighting apparatuses 102 via the optical cable 23. However, the locations of the light amount measuring apparatuses 40R, 40G, and 40B or the light mixing means 80 are not limited to this, and may be disposed between the light supply apparatus 101 and the lighting apparatuses 102, for example.

It is also possible that the light amount measuring apparatuses 40R, 40G, and 40B and the light mixing means 80 are provided in the lighting apparatuses 102, and that lights of different colors are transmitted from the light amount control units 60R, 60G, and 60B to the lighting apparatuses 102 via the optical cable 21, and that the lighting apparatuses 102 mix the lights of different colors.

Applications to Offices or Open Spaces

In the above embodiments, it is presumed that the lighting apparatuses 102 are provided in houses, where light is transmitted from the light supply apparatus 101 to the houses and supplied to each room of the houses as illumination light. However, the present invention can be applied to offices, factories, gymnasiums or the like so that each room space in the facilities is supplied with illumination light by the lighting apparatuses 102 provided therein.

Also, the present invention can be applied to open spaces. For example, the lighting apparatuses 102 may be provided beside the roads, in the parks or outdoor sports facilities or the like. In this case, the illumination units 30 will illuminate the spaces instead of the conventional lamps.

In these cases, the "users" are supposed to be the managers of the offices, factories, gymnasiums, roads, parks, or outdoor sports facilities.

Generally, illumination lamps for illuminating outdoor spaces are set up at higher positions than home lighting facilities. As a result, replacing lamps of outdoor illumination lamps is more difficult than that of lamps inside houses. However, by applying the illumination light supply system of the present system to such outdoor illumination lamps, the users are saved from the burdensome task of replacing defective lamps with unused ones.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. An illumination light supply system, comprising:

two or more light source units that generate and output lights of different colors;

mixing means for mixing the lights output from the two or more light source units;

light transfer means for transferring the mixed light output from the mixing means to a user; and an illumination unit that radiates the transferred light into a space for the user.

2. The illumination light supply system of claim 1 further comprising charging means for charging the user for illumination light the use has used.

3. The illumination light supply system of claim 2, wherein the charging means includes:

a light amount measuring unit that measures an amount of light transferred by the light transfer means to the user; and a storage unit that stores and accumulates the measured amount of light to have information of an accumulated amount of light, wherein the charging means charges the user an illumination light usage charge in accordance with the accumulated amount of light stored in the storage unit.

4. The illumination light supply system of claim 1 further comprising:

an input unit that receives light tone information input by the use ; and an adjustment unit that adjusts, in accordance with the put light tone information, an amount of light transferred by the light transfer means to the user.

5. An illumination light supply system, comprising:

two or more light source units that generate and output lights of different colors;

mixing means for mixing the lights output from the two or more light source units;

adjustment means for adjusting an amount of light supplied from each light source unit to the mixing means;

light transfer means for transferring the mixed light output from the mixing means to a user; and an illumination unit that radiates the transferred light into a space for the user.

6. The illumination light supply system of claim 5 further comprising an input unit that receives lighting environment information input by the user, wherein the adjustment means adjusts the amount of light supplied from each light source unit to the mixing means, in accordance with the lighting environment information received by the input unit.

7. The illumination light supply system of claim 6, wherein the adjustment means adjusts the amount of light supplied from each light source unit to the mixing means, by referring to a table showing correspondence between n contents of the lighting environment information and amounts of the lights to be supplied respectively from the two or more light source units to the mixing means.

8. The illumination light supply system of claim 5 further comprising:

a light amount measuring unit that measures an amount of light transferred by the light transfer means to the user; and a storage unit that stores and accumulates the measured amount of light to have information of an accumulated amount of light; and charging means for charging the user an illumination light sage charge in accordance with the accumulated amount of light stored in the storage unit.

9. The illumination light supply system of claim 5, wherein each light source unit has light dividing means for dividing the light generated by the light source unit into a plurality of lights, wherein the light transfer means transfers the plurality of lights from each light source unit.

10. An illumination light supply system, comprising:

two or more light source units that generate and output lights of different colors;

light transfer means for transferring the lights of different colors output from the two or more light source units to a user;

a mixing means for mixing the lights transferred by the light transfer means;

adjustment means for adjusting an amount of each of the lights transferred by the light transfer means; and an illumination unit that radiates the mixed light into a space for the user.

11. The illumination light supply system of claim 10 further comprising an input unit that receives lighting environment information input by the user, wherein the adjustment means adjusts the amount of each of the lights transferred by the light transfer means.

12. The illumination light supply system of claim 11, wherein the adjustment means adjusts the amount of each of the lights transferred by the light transfer means, by referring to a table showing correspondence between contents of the lighting environment information and amounts of the lights to be supplied respectively from the two or more light source units to the user.

13. The illumination light supply system of claim 10 further comprising:

a light amount measuring unit that measures an amount of light transferred by the light transfer means to the user; and a storage unit that stores and accumulates the measured amount of light to have information of an accumulated amount of light; and charging means for charging the user an illumination light sage charge in accordance with the accumulated amount of light stored in the storage unit.

14. The illumination light supply system of claim 10, wherein each light source unit has light dividing means for dividing the light generated by the light source unit into a plurality of lights, wherein the light transfer means transfers the plurality of lights from each light source unit.

15. A light supply system for illuminating an area to be used by people, comprising:

a source of light;

a light transfer member connected to the source of light and conducting the light to an area remote from the light source to illuminate the area;

a light control unit operatively connected to the light transfer member to regulate the transmission of light; and an input unit operatively positioned relative to the area to be illuminated and connected to the light control unit whereby a user can regulate the transmission of light from the remote source of light to the area.

16. The light supply system of claim 15 wherein the light control unit reflects light back to the source of light that is not transmitted.

17. The light supply system of claim 15 further including a light measuring unit to measure the amount of light delivered to the user to enable a user fee to be calculated.

18. The light supply system of claim 15 wherein the source of light comprises a plurality of light generators of different wavelengths and the input unit permits the user to select the wavelengths of light to illuminate the area.

19. The light supply system of claim 15 further including a second light transfer member connected to the source of light and conducting the light t a second area remote from the light source; a second control unit operatively connected to e second light t transfer member to regulate the transmission of light through the second light transfer member; and a second input unit operatively positioned relative to the second area to be illuminated and connected to the second light control unit whereby a user can regulate the transmission of light to the second area.

20. The light supply system of claim 19 further including a light measuring means to measure the amount of the respective light delivered to the user through the respective light transfer members to enable a calculation of user fees.

21. An illumination light supply system, comprising:

a light source unit that generates and outputs light;

a light transfer unit that transfers the light output from the light source to a user;

an illumination unit that radiates the transferred light into a space for the user; and a charging unit for determining a user charge for the amount of illumination light used includes:

a light amount measuring unit that measures an amount of light transferred by the light transfer unit to the user; and a storage unit that stores and accumulates the measured amount of light to provide information on an accumulated amount of light, wherein the charging unit enables an illumination light usage charge in accordance with the accumulated amount of light stored in the storage unit.

22. An illumination light supply system, comprising:

a light source that generates and outputs light;

an input unit that receives light tone information input by the user;

a light transfer unit that transfers the light output from the light source unit to a user;

an adjustment unit operatively connected to the input unit to adjust, in accordance with the input light tone information, an amount of light transferred by the light transfer unit to the user; and an illumination unit that radiates the transferred light into a space for the user.

* * * * *